US008882100B2

(12) United States Patent
Awano

(10) Patent No.: US 8,882,100 B2
(45) Date of Patent: Nov. 11, 2014

(54) POST-PROCESSING DEVICE, POST-PROCESSING METHOD, AND IMAGE FORMING APPARATUS

(71) Applicant: Fuji Xerox Co., Ltd., Tokyo (JP)

(72) Inventor: Hiroaki Awano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 9 days.

(21) Appl. No.: 13/683,189

(22) Filed: Nov. 21, 2012

(65) Prior Publication Data

US 2013/0285303 A1 Oct. 31, 2013

(30) Foreign Application Priority Data

Apr. 25, 2012 (JP) ..... 2012-100492

(51) Int. Cl.
*B65H 37/04* (2006.01)
*B65H 39/00* (2006.01)
*G03G 15/00* (2006.01)

(52) U.S. Cl.
CPC ..... *B65H 39/00* (2013.01); *B65H 37/04* (2013.01); *G03G 15/6544* (2013.01); *G03G 2215/00852* (2013.01); *B65H 2801/27* (2013.01)
USPC ..... 270/58.08; 270/58.07; 270/58.11; 399/407; 399/408

(58) Field of Classification Search
USPC ..... 270/58.07, 58.08, 58.11, 58.12, 58.17, 270/58.27; 399/407, 408, 410
See application file for complete search history.

(56) References Cited

U.S. PATENT DOCUMENTS

| | | | | |
|---|---|---|---|---|
| 5,772,198 | A * | 6/1998 | Yamamoto | 270/58.12 |
| 5,899,841 | A * | 5/1999 | Berger | 493/351 |
| 6,283,354 | B1 * | 9/2001 | Hirota et al. | 227/39 |
| 6,371,472 | B1 * | 4/2002 | Miyake et al. | 270/58.14 |
| 2011/0222945 | A1 * | 9/2011 | Sato | 399/408 |
| 2011/0236158 | A1 * | 9/2011 | Shiraishi | 412/33 |

FOREIGN PATENT DOCUMENTS

| | | | |
|---|---|---|---|
| JP | 49-5960 | A | 2/1974 |
| JP | 08-300847 | A | 11/1996 |
| JP | 2903492 | B2 | 3/1999 |
| JP | 2006-008370 | A | 1/2006 |
| JP | 2010-285272 | A | 12/2010 |
| JP | 2011-116490 | A | 6/2011 |
| JP | 2011-201160 | A | 10/2011 |
| JP | 2011-201162 | A | 10/2011 |
| JP | 2011-201164 | A | 10/2011 |
| JP | 2011-201165 | A | 10/2011 |
| JP | 2011-201660 | A | 10/2011 |
| JP | 2011-201689 | A | 10/2011 |
| JP | 2011-203606 | A | 10/2011 |

* cited by examiner

*Primary Examiner* — Leslie A Nicholson, III
(74) *Attorney, Agent, or Firm* — Sughrue Mion, PLLC

(57) ABSTRACT

A post-processing device includes a sheet-bundle forming unit that stacks plural sheets and forms a sheet bundle; a binding unit that forms a cut in the sheet bundle, forms a tongue in the sheet bundle by cutting part of the sheet bundle into a predetermined shape so that a first end remains uncut and continues to the sheet bundle, and binds the sheet bundle by folding the tongue and inserting a second end of the tongue into the cut; a transport unit that transports the sheet bundle; a stack unit that stacks the sheet bundle; and a position change unit that changes a position of binding processing performed on the sheet bundle so that the tongue formed in the sheet bundle stacked on the stack unit does not contact another tongue formed in another sheet bundle stacked on the stack unit.

1 Claim, 13 Drawing Sheets

POST-PROCESSING DEVICE, POST-PROCESSING METHOD, AND IMAGE FORMING APPARATUS

CROSS-REFERENCE TO RELATED APPLICATIONS

This application is based on and claims priority under 35 USC 119 from Japanese Patent Application No. 2012-100492 filed Apr. 25, 2012.

BACKGROUND

The present invention relates to a post-processing device, a post-processing method, and an image forming apparatus.

SUMMARY

According to an aspect of the invention, there is provided a post-processing device including a sheet-bundle forming unit that stacks plural sheets and forms a sheet bundle; a binding unit that forms a cut in the sheet bundle formed by the sheet-bundle forming unit, forms a tongue in the sheet bundle by cutting part of the sheet bundle into a predetermined shape so that a first end remains uncut and continues to the sheet bundle, and binds the sheet bundle by folding the tongue and inserting a second end of the tongue into the cut; a transport unit that transports the sheet bundle bound by the binding unit; a stack unit that stacks the sheet bundle transported by the transport unit; and a position change unit that changes a position of binding processing performed on the sheet bundle by the binding unit so that the tongue formed in the sheet bundle stacked on the stack unit does not contact another tongue formed in another sheet bundle stacked on the stack unit.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below in detail with reference to the accompanying drawings.

Image Forming System 1

Figure 1:
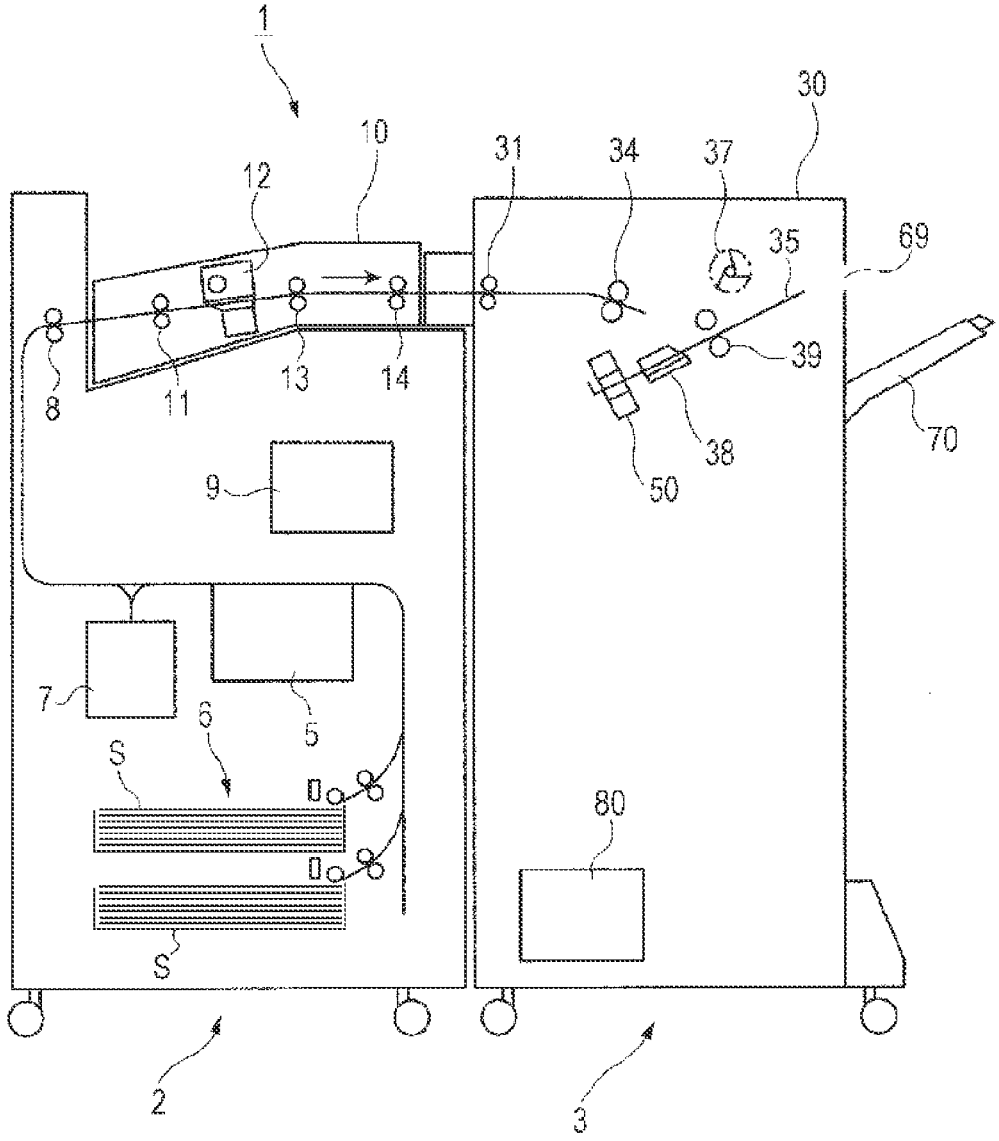
FIG. 1 is a schematic configuration diagram showing an image forming system to which an exemplary embodiment of the present invention is applied.

FIG. 1 is a schematic configuration diagram showing an image forming system (an image forming apparatus) 1 to which this exemplary embodiment is applied. The image forming system 1 shown in FIG. 1 includes an image forming apparatus 2, such as a printer or a copier, that forms an image, for example, by an electrophotographic system; and a sheet processing apparatus 3 that performs post-processing for a sheet S, on which, for example, a toner image is formed by the image forming apparatus 2.

Image Forming Apparatus 2

The image forming apparatus 2 includes a sheet feed unit 6 that feeds a sheet S, on which an image is formed; and an image forming unit (an image forming mechanism) 5 that forms an image on the sheet S, which is fed from the sheet feed unit 6. Also, the image forming apparatus 2 includes a sheet reverse device 7 that reverses the surface of the sheet S with the image formed thereon by the image forming unit 5; and an output roller 8 that outputs the sheet S with the image formed thereon. Further, the image forming apparatus 2 includes a user interface 9 that receives information relating to binding processing from a user.

Sheet Processing Apparatus 3

The sheet processing apparatus 3 includes a transport device 10 that transports a sheet S output from the image forming apparatus 2 to a further downstream side; and a post-processing device 30 including, for example, a compiling stack portion 35 that collects and groups sheets S and a staple-less binding mechanism 50 that binds end parts of the sheets S. In the illustrated exemplary embodiment, the sheet processing apparatus 3 includes a controller 80 that is an example of a position change mechanism, a rotation unit, and a switch unit, and that controls the entire image forming system 1.

The transport device 10 of the sheet processing apparatus 3 includes an entrance roller 11 including a pair of rollers that receive a sheet S output through the output roller 8 of the image forming apparatus 2; and a puncher 12 that makes holes if necessary in the sheet S received by the entrance roller 11. Also, the transport device 10 includes a first transport roller 13 provided further downstream of the puncher 12 and including a pair of rollers that transport the sheet S to the downstream side; and a second transport roller 14 including a pair of rollers that transport the sheet S toward the post-processing device 30.

The post-processing device 30 of the sheet processing apparatus 3 includes a receive roller 31 including a pair of rollers that receive a sheet S from the transport device 10. Also, the post-processing device 30 includes the compiling stack portion 35 that is provided downstream of the receive roller 31, stacks plural sheets S, and forms a sheet bundle B; and an exit roller 34 including a pair of rollers that output the sheets S toward the compiling stack portion 35.

Also, the post-processing device 30 includes a paddle 37 that rotates to push the sheets S to an end guide 35*b* (described later) of the compiling stack portion 35. Further, the post-processing device 30 includes a tamper 38 that aligns ends of the sheets S. Further, the post-processing device 30 includes an eject roller 39 that is an example of a transport unit and transports the sheet bundle B by pressing the sheets S stacked on the compiling stack portion 35 and by rotating.

The post-processing device 30 also includes the staple-less binding mechanism 50 that binds an end part of the sheet bundle B stacked on the compiling stack portion 35. The post-processing device 30 further includes an opening 69 through which the eject roller 39 outputs the sheet bundle B to the outside of the post-processing device 30. The post-processing device 30 further includes a stack portion 70 that is an example of a stack unit and stacks the sheet bundle B output through the opening 69 so that the user easily picks up the sheet bundle B.

Structure of Periphery of Compiling Stack Portion 35

Figure 2:
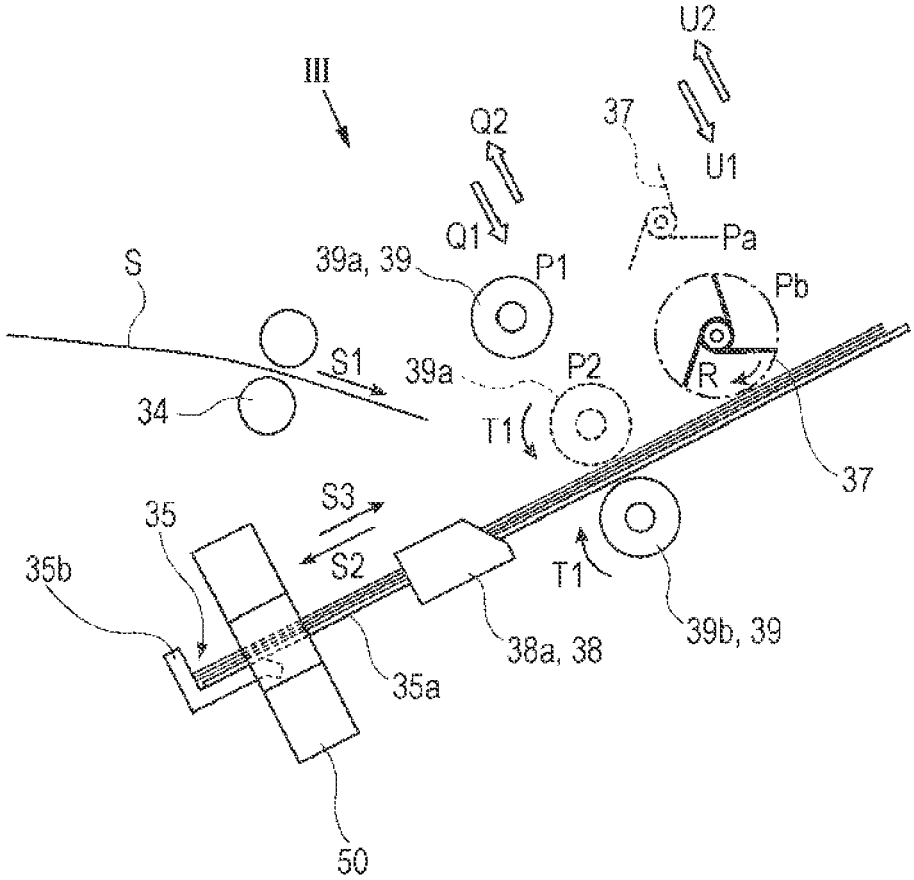
FIG. 2 is a schematic configuration diagram showing the periphery of a compiling stack portion.
Figure 3:
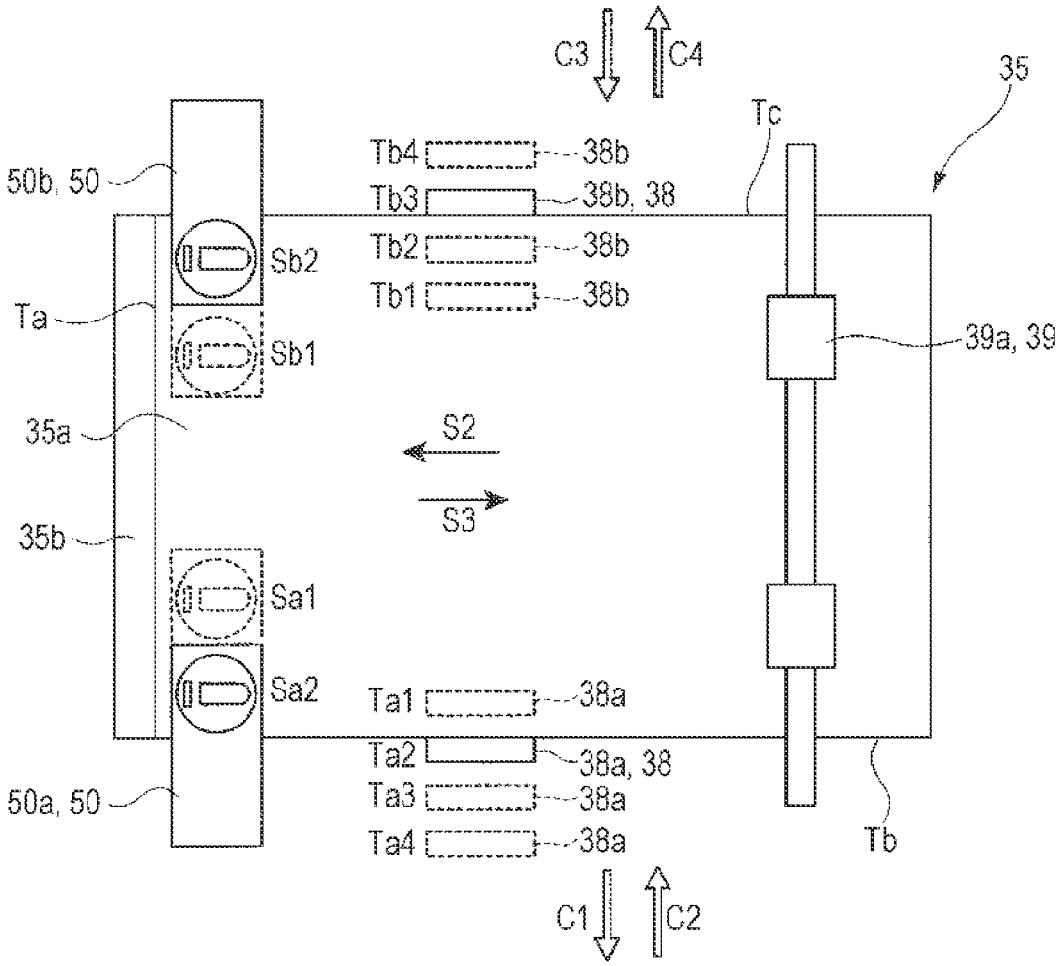
FIG. 3 is a schematic configuration diagram showing the periphery of the compiling stack portion when viewed in a direction indicated by arrow III in FIG. 2.

Next, the structure of the compiling stack portion 35 and its periphery is described with reference to FIGS. 2 and 3. FIG. 2 is a schematic configuration diagram showing the periphery of the compiling stack portion 35. FIG. 3 is a schematic configuration diagram showing the periphery of the compiling stack portion 35 when viewed in a direction indicated by arrow III in FIG. 2.

The lower side in FIG. 3 indicates the user side of the image forming system 1, and corresponds to the front side of each paper face of FIGS. 1 and 2.

The compiling stack portion 35, which is an example of a sheet-bundle forming unit, includes a bottom portion 35*a* having an upper surface on which sheets S are stacked. The bottom portion 35*a* is inclined so that the sheets S fall along the upper surface.

Also, the compiling stack portion 35 includes the end guide 35*b* arranged to align leading ends in a travel direction of the sheets S falling along the bottom portion 35*a*.

Although it is described later in detail, regarding the movement of a sheet S in the periphery of the compiling stack portion 35, the sheet S is fed toward the compiling stack portion 35 first (see a first travel direction S1 in FIG. 2), and the travel direction is reversed next, so that the sheet S falls along the bottom portion 35*a* of the compiling stack portion 35 (see a second travel direction S2 in FIG. 2). Then, the ends of respective sheets S are aligned and a sheet bundle B is formed. The travel direction of the sheet bundle B is reversed, so that the sheet bundle B moves upward along the bottom portion 35*a* of the compiling stack portion 35 (see a third travel direction S3 in FIG. 2).

Referring to FIG. 3, in this exemplary embodiment, respective ends of the bottom portion 35*a* of the compiling stack portion 35 are defined as follows. An end at the leading side in the second travel direction S2 indicative of the direction in which the sheet S falls along the upper surface of the bottom portion 35*a* of the compiling stack portion 35 is called leading end Ta. The leading end Ta contacts the end guide 35*b*. Also, an end extending in the second travel direction S2 and located at the user side (lower side in FIG. 3) of the image forming system 1 is called first lateral end Tb. Further, an end opposite to the first lateral end Tb, or in particular, an end extending in the second travel direction S2 and located at the deep side (upper side in FIG. 3) of the image forming system 1 is called second lateral end Tc.

The paddle 37 is provided above the compiling stack portion 35 and downstream of the exit roller 34 in the first travel direction S1 of the sheet S. The paddle 37 is provided so that the distance between the paddle 37 and the bottom portion 35*a* of the compiling stack portion 35 is changed when receiving driving of a motor or the like (not shown). Specifically, the paddle 37 is provided movably in directions indicated by arrows U1 and U2 in FIG. 2. When the paddle 37 moves in the direction indicated by arrow U1, the paddle 37 approaches the bottom portion 35*a* of the compiling stack portion 35 (position Pb illustrated by solid lines). When the paddle 37 moves in the direction indicated by arrow U2, the paddle 37 moves away from the bottom portion 35*a* of the compiling stack portion 35 (position Pa illustrated by broken lines). The paddle 37 rotates in a direction indicated by arrow R in FIG. 2 to push the sheet S transported in the first travel direction S1 in FIG. 2, in the second travel direction S2 on the compiling stack portion 35.

The tamper 38 being an example of an arrangement mechanism includes a first tamper 38*a* and a second tamper 38*b* facing each other with the compiling stack portion 35 interposed therebetween. Specifically, the first tamper 38*a* and the second tamper 38*b* are arranged to face each other in a direction (vertical direction in FIG. 3) intersecting with the second travel direction S2. The distance between the first tamper 38*a* and the second tamper 38*b* is changed when receiving driving of a motor or the like (not shown) to align ends of the sheets S along the travel direction of sheets S falling along the bottom portion 35*a*.

In the illustrated exemplary embodiment, the first tamper 38*a* is movable along the leading end Ta (arrows C1 and C2), and may be arranged at four positions Ta1 to Ta4. Also, the second tamper 38*b* is movable along the leading end Ta (arrows C3 and C4), and may be arranged at four positions Tb1 to Tb4.

The positions Ta1 to Ta4 of the first tamper 38*a* and the positions Tb1 to Tb4 of the second tamper 38*b* according to this exemplary embodiment may be changed in accordance with the size and orientation of the sheets S fed to the compiling stack portion 35.

The eject roller 39 includes a first eject roller 39*a* and a second eject roller 39*b*. The first eject roller 39*a* and the second eject roller 39*b* are arranged above and below the bottom portion 35*a* of the compiling stack portion 35 and face each other with the bottom portion 35*a* arranged therebetween.

The first eject roller 39*a* is provided at a side near a surface of the bottom portion 35*a* of the compiling stack portion 35, the surface on which the sheets S are stacked. Further, the first eject roller 39*a* may be advanced to and retracted from the second eject roller 39*b* when receiving driving of a motor or the like (not shown). In contrast, the second eject roller 39*b* is arranged at a side near a back surface of the bottom portion 35*a* of the compiling stack portion 35, the surface on which the sheets S are not stacked. The position of the second eject roller 39*b* is fixed and is only allowed to rotate.

Specifically, when the first eject roller 39*a* moves in a direction indicated by arrow Q1, the first eject roller 39*a* approaches the bottom portion 35*a* of the compiling stack portion 35 (position P2 illustrated by broken lines). In contrast, when the first eject roller 39*a* moves in a direction indicated by arrow Q2, the first eject roller 39*a* moves away from the bottom portion 35*a* of the compiling stack portion 35 (position P1 illustrated by solid lines).

The first eject roller 39*a* receives driving of a motor or the like (not shown) while the first eject roller 39*a* contacts the sheet S, and rotates in a direction indicated by arrow T1. Accordingly, the sheet bundle B is moved upward (in the third travel direction S3) and transported.

The positions P1 and P2 of the first eject roller 39*a* may be changed in accordance with the number and thickness of sheets S that are fed to the compiling stack portion 35.

Staple-Less Binding Mechanism 50

The staple-less binding mechanism 50 being an example of a binding unit is described.

As shown in FIG. 3, the staple-less binding mechanism 50 includes a first staple-less binding mechanism 50*a* and a second staple-less binding mechanism 50*b* facing each other with the compiling stack portion 35 arranged therebetween. The first staple-less binding mechanism 50*a* and the second staple-less binding mechanism 50*b* have configurations similar to each other except that the arrangements are vertically reversed (described later).

The first staple-less binding mechanism 50*a* is provided at a corner arranged between the leading end Ta and the first lateral end Tb. The second staple-less binding mechanism 50*b* is arranged at a corner between the leading end Ta and the second lateral end Tc.

Also, the first staple-less binding mechanism 50*a* is movable along the leading end Ta when receiving driving of a motor or the like (not shown) (arrows C1 and C2), and may be arranged at two positions Sa1 and Sa2. Also, the second staple-less binding mechanism 50*b* is movable along the leading end Ta when receiving driving of a motor or the like (not shown) (arrows C3 and C4), and may be arranged at two positions Sb1 and Sb2.

The illustrated exemplary embodiment provides the configuration including the two first and second staple-less binding mechanisms 50*a* and 50*b*. The first staple-less binding mechanism 50*a* may serve as a first binding mechanism, and the second staple-less binding mechanism 50*b* may serve as a second binding mechanism.

Alternatively, as long as binding processing is performed at a position near the first lateral end Tb and a position near the second lateral end Tc, for example, rails (not shown) may be provided along the first lateral ends Tb, the leading end Ta, and the second lateral end Tc, and a single binding mechanism 50 may move on the rails when receiving driving of a motor or the like (not shown). In this case, the binding mechanism 50 may serve as a first binding mechanism, and the rails (not shown) and the motor (not shown) may serve as a second binding mechanism.

Figure 4A:
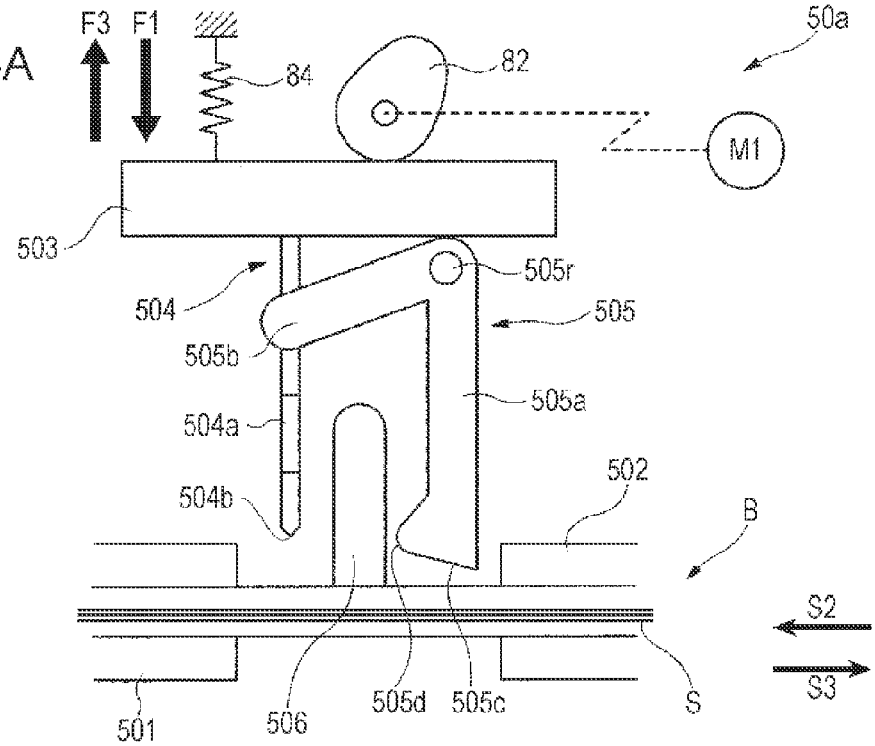
FIGS. 4A and 4B each are a schematic configuration diagram showing a staple-less binding mechanism and its peripheral members.
Figure 4B:
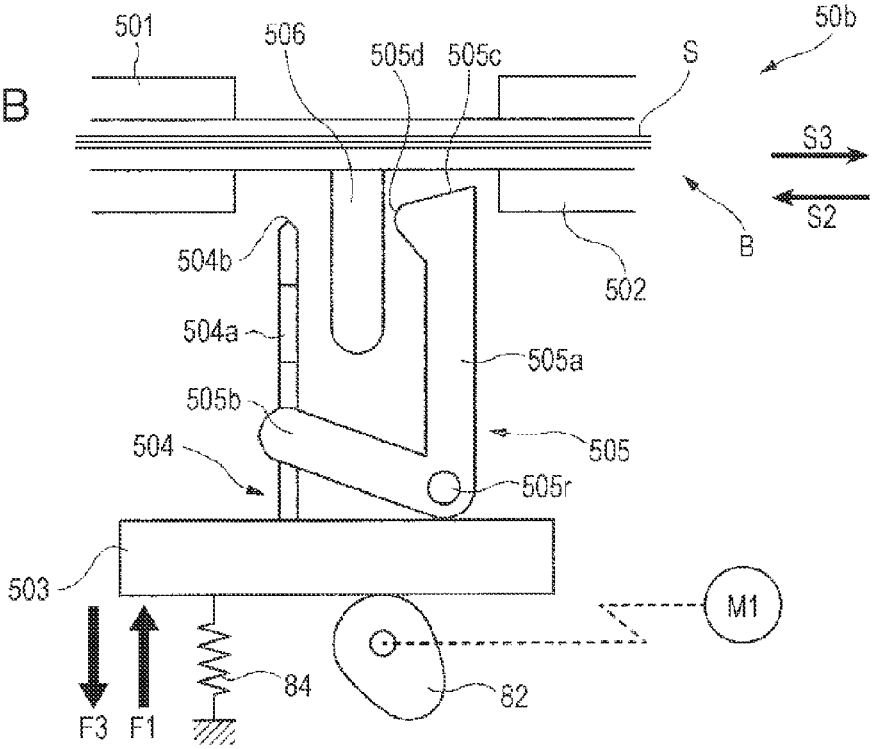

Then, the two binding mechanisms 50*a* and 50*b* are further described with reference to FIGS. 1, and 4A and 4B. FIGS. 4A and 4B each are a schematic configuration diagram showing the staple-less binding mechanism 50 and its peripheral members. To be more specific, FIG. 4A shows the first staple-less binding mechanism 50*a* when viewed from the user side (the front side of paper face of FIG. 1) of the image forming system 1, and FIG. 4B shows the second staple-less binding mechanism 50*b* when viewed from the user side of the image forming system 1.

As shown in FIG. 4A, the first staple-less binding mechanism 50*a* includes a staple-less binding motor M1 that is controlled by the controller 80 (see FIG. 1) and drives the first staple-less binding mechanism 50*a*. Also, the first staple-less binding mechanism 50*a* includes a cam 82 that rotates when receiving driving from the staple-less binding motor M1 and transmits a driving force, and a spring 84 that applies a force in the reverse direction of the direction of the driving force transmitted by the cam 82.

The first staple-less binding mechanism 50*a* (and the second staple-less binding mechanism 50*b*) binds an end part of a sheet bundle B by deforming sheets S forming the sheet bundle B without use of a stapler binding needle (so-called staple). Specifically, the first staple-less binding mechanism 50*a* is configured as follows.

The first staple-less binding mechanism 50*a* includes a pedestal 501 and a base 503 arranged to face each other. Referring to FIG. 4A, the base 503 approaches the pedestal 501 (in F1 direction in the drawing) while the sheet bundle B is pinched at the pedestal 501. As a result, the sheet bundle B is bound.

The pedestal 501 has a holding member 502 arranged substantially in parallel to the pedestal 501. The pedestal 501 and the holding member 502 are provided to face each other with the bottom portion 35*a* (see FIG. 2) of the compiling stack portion 35 arranged therebetween. The sheet bundle B on the compiling stack portion 35 is pinched between the pedestal 501 and the holding member 502. Referring to FIG. 4A, the pedestal 501 also includes a protrusion 506 that extends toward the base 503 and is integrally formed with the pedestal 501.

The base 503 includes a blade 504 that makes a cut in the sheet bundle B, and a punching member 505 that forms a tongue 522 (described later) in the sheet bundle B, folds the tongue 522, and inserts the tongue 522 into the cut formed by the blade 504.

The blade 504 is made of a substantially rectangular plate member extending toward the sheet bundle B pinched between the pedestal 501 and the holding member 502. Specifically, the blade 504 has an eyelet hole 504*a* in the substantially rectangular surface, and a distal end portion 504*b* with a width that is decreased toward the sheet bundle B.

The punching member 505 is a member including a substantially L-shaped bent part. A first end of the punching member 505 is a first portion 505*a* and a second end is a second portion 505*b*.

The punching member 505 includes a first-portion rotation shaft 505*r* provided at the substantially L-shaped bent part. The punching member 505 is rotatable around the first-portion rotation shaft 505*r*. Since the punching member 505 rotates around the first-portion rotation shaft 505*r* as the center, the first portion 505*a* contacts and is separated from the blade 504. It is to be noted that a gap is provided between the second portion 505*b* and the base 503 to allow the punching member 505 to rotate.

The first portion 505*a* extends toward the pedestal 501. Also, the first portion 505*a* has a cutting edge 505*c* at a side opposite to a side provided with the first-portion rotation shaft 505*r*, i.e., at a side facing the pedestal 501. The cutting edge 505*c* has a cutting edge that punches the shape of the tongue 522. The cutting edge 505*c* does not have a cutting edge at a side facing the blade 504, and is configured so that the tongue 522 continues to the sheets S at a first end 522*a* (described later). Further, the first portion 505*a* includes a protrusion 505*d* at a side of the first portion 505*a*, in particular, at a side facing the blade 504. The protrusion 505*d* extends toward the blade 504.

Referring to FIG. 4A, the first staple-less binding mechanism 50*a* includes the pedestal 501 and the base 503 provided above the pedestal 501. In contrast, referring to FIG. 4B, the second staple-less binding mechanism 50*b* has the vertically reversed arrangement of the arrangement of the first staple-less binding mechanism 50*a*. The pedestal 501 is arranged above the base 503.

If a single staple-less binding mechanism 50 moves and performs the binding processing unlike FIGS. 4A and 4B, a switch mechanism that switches the up-down direction of the staple-less binding mechanism 50 between the first lateral end Tb and the second lateral end Tc. In other words, the first staple-less binding mechanism 50*a* and the second staple-less binding mechanism 50*b* do not have to have reversed up-down directions, and may have aligned up-down directions.

Operation of Staple-Less Binding Mechanism 50

Referring to FIGS. 1 to 5D, an operation of binding an end part of a sheet bundle B stacked on the compiling stack portion 35 by the staple-less binding mechanism 50 is described in detail.

Figure 5A:
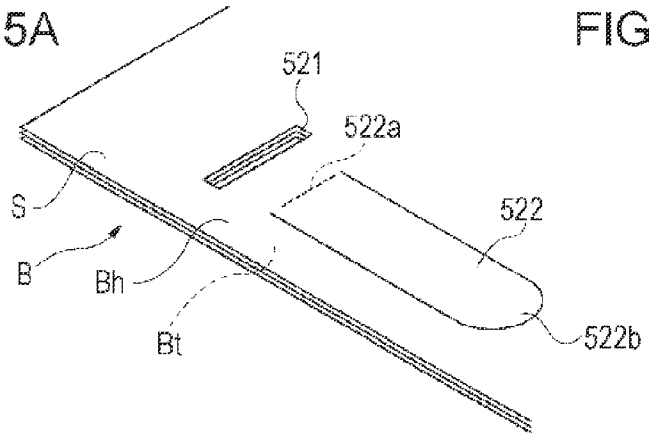
FIGS. 5A to 5D each are an explanatory view showing a part bound by the staple-less binding mechanism.
Figure 5B:
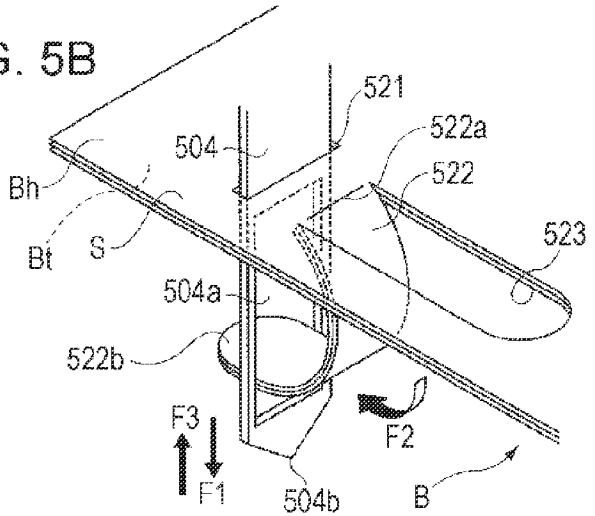
Figure 5C:
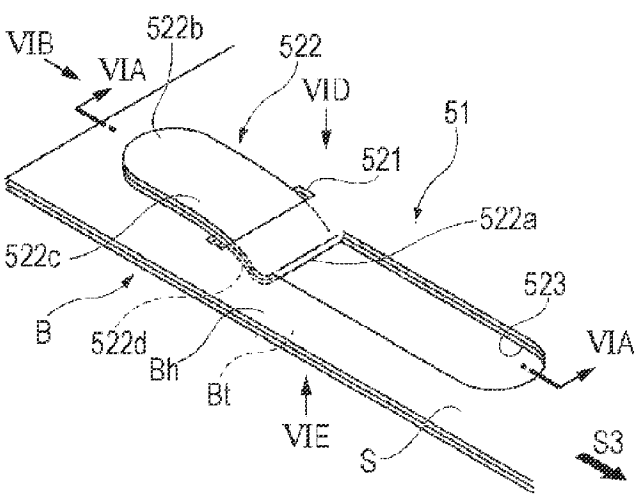
Figure 5D:
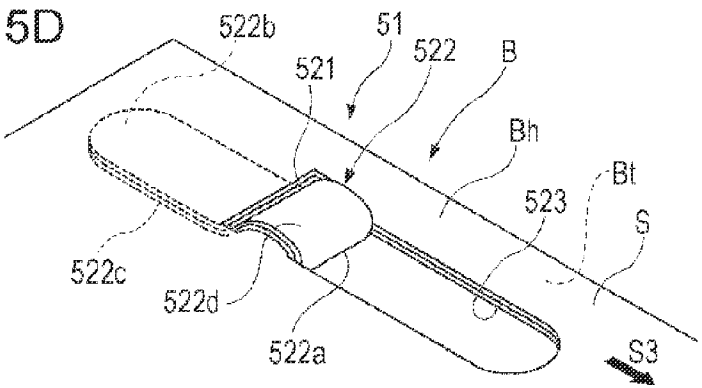

FIGS. 5A to 5D each are an explanatory view showing a part bound by the staple-less binding mechanism 50. To be more specific, FIG. 5A is an explanatory view showing the positional relationship between the slit 521 and the tongue 522, FIG. 5B is an explanatory view showing the relationship between the slit 521 and the tongue 522 to be bound by the first staple-less binding mechanism 50*a*, FIG. 5C is an explanatory view showing a bound part 51 bound by the first staple-less binding mechanism 50*a*, and FIG. 5D is an explanatory view showing a bound part 51 bound by the second staple-less binding mechanism 50*b*.

First, when a sheet bundle B as a target of the binding processing is stacked on the compiling stack portion 35, the first staple-less binding mechanism 50*a* is arranged at the position Sa1 or the position Sa2 and the second staple-less binding mechanism 50*b* is arranged at the position Sb1 or the position Sb2 by driving of a motor or the like (not shown) in response to a signal from the controller 80. The following description is provided for the operation of the binding processing by the first staple-less binding mechanism 50*a*. However, the second staple-less binding mechanism 50*b* operates similarly to the first staple-less binding mechanism 50*a* except that the up-down direction is reversed.

At the position Sa1 or the position Sa2, the staple-less binding motor M1, which receives an instruction from the controller 80, is driven and rotates the cam 82. Hence, the base 503 approaches the pedestal 501 (F1 direction in FIG. 4A), and the distal end portion 504*b* of the blade 504 and the cutting edge 505*c* of the punching member 505 penetrate through the sheet bundle B. Then, the slit (the cut) 521 and the tongue 522 are formed in each of sheets S forming the sheet bundle B. The tongue 522 is punched in the sheets S so that the first end 522*a* remains not to be punched (see FIG. 5A).

Referring to FIG. 4A, when the cam 82 rotates and the base 503 is further pushed down, the second portion 505*b* of the punching member 505 contacts the protrusion 506 integrally formed with the pedestal 501, and the punching member 505 rotates clockwise in FIG. 4A around the first-portion rotation shaft 505*r*. Accordingly, the first portion 505*a* is inclined toward the blade 504, and the protrusion 505*d* of the punching member 505 approaches the blade 504. The protrusion 505*d* of the punching member 505 folds the tongue 522 as shown in FIG. 5B, and pushes the tongue 522 in a F2 direction in the drawing toward the eyelet hole 504*a* of the blade 504. It is to be noted that FIG. 5B does not illustrate the punching member 505.

Referring to FIG. 4A, after the cam 82 further rotates and passes through the lower dead point, the base 503 moves away from the pedestal 501 while receiving a force from the spring 84 (see F3 in the drawing). The base 503 moves in the F3 direction in the drawing while the tongue 522 is hooked to the eyelet hole 504*a* of the blade 504.

Referring to FIG. 5C, the tongue 522 is inserted (woven) into the slit 521. Thus, the sheet bundle B is bound. At this time, the sheet bundle B has a binding hole 523 at a position where the tongue 522 is punched. In this exemplary embodiment, the slit 521, the tongue 522, and the binding hole 523 define a part with the binding processing performed (the bound part) 51.

Referring to FIG. 5C, the bound part 51 bound by the first staple-less binding mechanism 50*a* has a second end 522*b* that is a distal end of the tongue 522, at an upper surface Bh of the sheet bundle B. In contrast, referring to FIG. 5D, a bound part 51 bound by the second staple-less binding mechanism 50*b* has a second end 522*b* that is the distal end of the tongue 522, at a lower surface Bt of the sheet bundle B.

Bound Part 51

Next, the bound part 51 will be described with reference to FIGS. 5A to 5D and 6A to 6F.

Figure 6A:
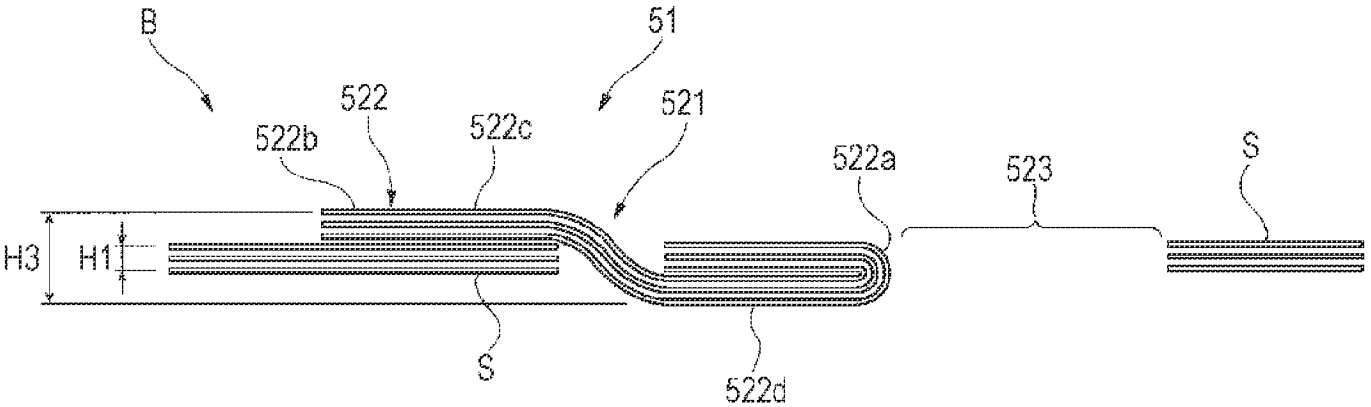
FIGS. 6A to 6F each are an explanatory view showing a part bound in a sheet bundle.
Figure 6C:
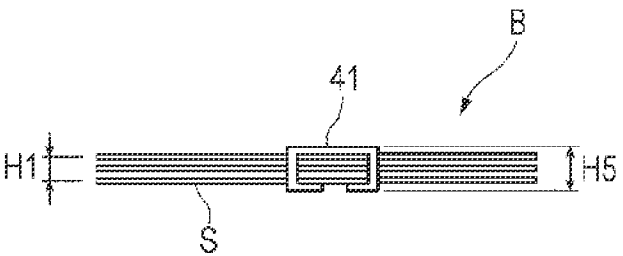
Figure 6B:
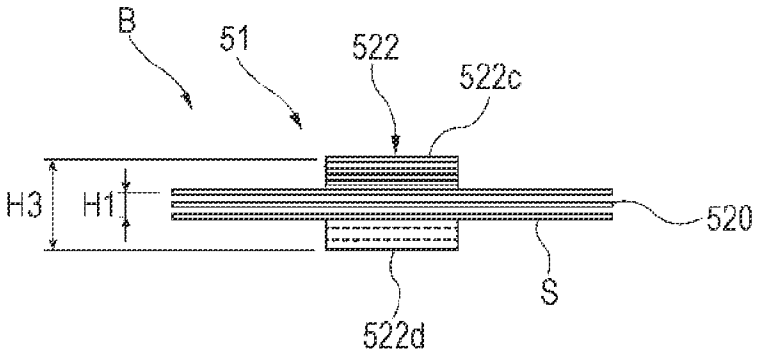
Figure 6D:
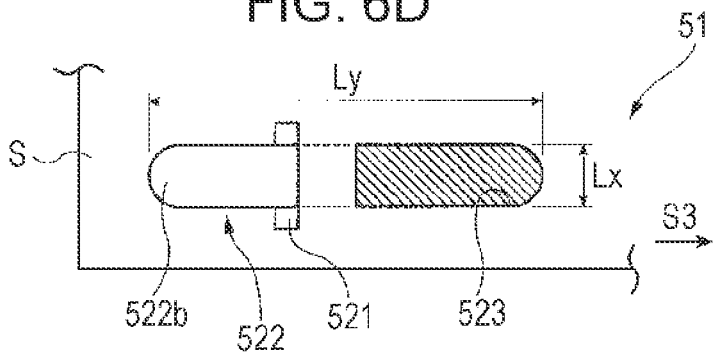
Figure 6E:
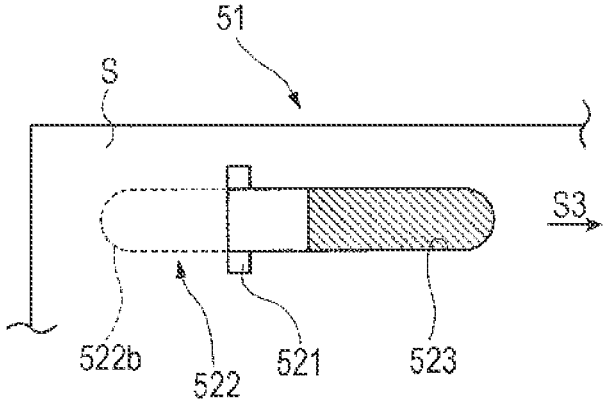
Figure 6F:
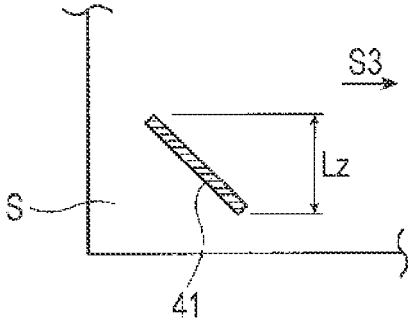

FIGS. 6A to 6F each are an explanatory view showing a part bound in a sheet bundle B. To be more specific, FIG. 6A is a cross-sectional view when viewed in a direction along line VIA-VIA in FIG. 5C, FIG. 6B is a cross-sectional view when viewed in a direction indicated by arrow VIB in FIG. 5C, FIG. 6C is a cross-sectional view of a bound part bound by a staple 41, FIG. 6D is a plan view when viewed in a direction indicated by arrow VID in FIG. 5C, FIG. 6E is a plan view when viewed in a direction indicated by arrow VIE in FIG. 5C, and FIG. 6F is a plan view of a part bound by the staple 41.

First, the orientation of the bound part 51 is described.

Referring to FIGS. 5C and 5D, the tongue 522 of the bound part 51 bound by either of the first staple-less binding mechanism 50*a* and the second staple-less binding mechanism 50*b* is formed along the direction in which the sheet bundle B is transported (the third travel direction S3). Also, the tongue 522 is arranged so that a proximal end (the first end 522*a*, the first end) of the tongue 522 is located downstream of a distal end (the second end 522*b*, the second end) of the tongue 522 in the transport direction (the third travel direction S3) in which the sheet bundle B is transported. Accordingly, the tongue 522 is prevented from being hooked to another member when the sheet bundle B is transported, and for example, the tongue 522 is prevented from being damaged.

Also, the tongue 522 is arranged so that the distal end (the second end 522*b*) of the tongue 522 is directed to the outside of the sheets S forming the sheet bundle B. In other words, the distal end of the tongue 522 is arranged closer to the ends of the sheets S than the proximal end (the first end 522*a*) of the tongue 522 is.

For example, if the user opens the sheet bundle B, the user gradually turns over the sheets S forming the sheet bundle B while the user pinches part of one of the sheets S. At this time, the pinched part of one of the sheets S is typically located at an end part of the sheet bundle B other than the corner part where the bound part 51 is formed at the sheet bundle B. As the sheets S are turned from the pinched part, the bound part 51 is gradually opened from a center part of the sheets S.

At this time, since the distal end (the second end 522*b*) of the tongue 522 is arranged to face the outside of the sheets S as illustrated, when the tongue 522 receives an opening force from the center part of the sheets S, the tongue 522 receives a force in a direction in which the tongue 522 enters the slit 521.

In contrast, unlike the illustrated exemplary embodiment, if the distal end (the second end 522*b*) of the tongue 522 is arranged to face the center part of the sheets S, when the tongue 522 receives an opening force from the center part of the sheets S, the tongue 522 receives a force in a direction in which the tongue 522 comes out of the slit 521.

Hence, if the distal end of the tongue 522 is arranged to face the outside of the sheets S as illustrated, the bound state of the bound part 51 is hardly loosened, as compared with a case in which the distal end of the tongue 522 is arranged to face the center part of the sheets S unlike the illustrated exemplary embodiment.

Next, the dimension of the bound part 51 is described.

First, as shown in FIGS. 6A and 6B, the tongue 522 of the bound part 51 has a first part 522*c* protruding from the upper surface Bh (see FIG. 5C) of the sheet bundle B, and a second part 522*d* protruding from the lower surface Bt (see FIG. 5C)

of the sheet bundle B. The first part 522*c* and the second part 522*d* each have at least a thickness equivalent to a height H1 of the sheet bundle B. Hence, the bound part 51 has bulges at the front and back surfaces of the sheet bundle B. The bound part 51 has a height H3 that is at least three times the height H1 of the sheet bundle B.

Also, if the number of sheets of the sheet bundle B is large, the rigidity of the tongue 522 is increased. Hence, the first part 522*c* and the second part 522*d* further protrude from the sheet bundle B by a height larger than the height H1 of the sheet bundle B. Thus, the height H3 of the bound part 51 becomes further large.

In contrast, as shown in FIG. 6C, if the binding processing is performed with a staple 41 as a comparative example, the bound part has a height H5 that is approximately equivalent to, for example, (the height H1 of the sheet bundle B)+2 mm. Hence, the larger the thickness of the sheet bundle B, the larger the thickness of the bound part 51, as compared with the bound part with the staple 41.

Also, as shown in FIGS. 6D and 6E, a length in a direction intersecting with (orthogonal to) the third travel direction S3, i.e., a length in the width direction (a length Lx) of the tongue 522 of the bound part 51 is smaller than a length in the longitudinal direction (a length Ly) of the bound part 51. If normal paper made of a typical paper material is used as the sheets S forming the sheet bundle B, the length Lx is, for example, 5 mm.

In contrast, referring to FIG. 6F, if the staple 41 is arranged in an inclined manner with respect to the third travel direction S3 by 60 degrees as a comparative example, a length Lz in a direction intersecting with (orthogonal to) the third travel direction S3 is, for example, about 9 mm. Thus, the above-described bound part 51 has a smaller length in the direction intersecting with the third travel direction S3 than that length of the bound part bound with the staple 41.

Operation of Image Forming System 1

Next, the operation of the image forming system 1 will be described with reference to FIGS. 1 to 3. Described here is a case in which the first staple-less binding mechanism 50*a* performs the binding processing on the sheet bundle B from among the first staple-less binding mechanism 50*a* and the second staple-less binding mechanism 50*b*. However, an operation similar to that of the first staple-less binding mechanism 50*a* is provided even when the second staple-less binding mechanism 50*b* performs the binding processing on the sheet bundle B.

In this exemplary embodiment, information relating to an image to be formed on sheets S and information relating to binding processing are received through a personal computer (not shown), the user interface 9, etc. When the controller 80 receives the information, the operation of the image forming system 1 is started.

The respective members are arranged as follows before the image forming unit 5 of the image forming apparatus 2 forms a toner image on a first sheet S. In particular, the first eject roller 39*a* is arranged at the position P1, the paddle 37 is arranged at the position Pa, the first tamper 38*a* is arranged at the position Ta4, and the second tamper 38*b* is arranged at the position Tb3. Also, the first staple-less binding mechanism 50*a* is arranged at the position Sa2.

Then, the image forming unit 5 of the image forming apparatus 2 forms the toner image on the first sheet S. As shown in FIG. 1, the first sheet S with the toner image formed is reversed if necessary by the sheet reverse device 7. Then, the first sheet S is fed to the sheet processing apparatus 3 through the output roller 8 one by one.

The transport device 10 of the sheet processing apparatus 3 to which the first sheet S is fed receives the first sheet S with the entrance roller 11, and performs punching processing for the first sheet S if necessary with the puncher 12. Then, the first sheet S is transported toward the downstream post-processing device 30 through the first transport roller 13 and the second transport roller 14.

The post-processing device 30 receives the first sheet S from the receive roller 31. The first sheet S passed through the receive roller 31 is transported in the first travel direction S1 by the exit roller 34. At this time, the first sheet S is transported so as to pass through a position between the compiling stack portion 35 and the first eject roller 39*a* and through a position between the compiling stack portion 35 and the paddle 37.

After the leading end of the first sheet S in the first travel direction S1 passes through the position between the compiling stack portion 35 and the paddle 37, the paddle 37 moves downward from the position Pa (moves in the direction indicated by arrow U1 in FIG. 2) and is arranged at the position Pb. Hence, the paddle 37 contacts the first sheet S. The first sheet S is pushed in the second travel direction S2 in FIG. 2 by the rotation of the paddle 37 in the direction indicated by arrow R in FIG. 2. The end of the first sheet S close to the end guide 35*b* contacts the end guide 35*b*. Then, the paddle 37 moves upward (moves in the direction indicated by arrow U2 in FIG. 2), is separated from the first sheet S, and is located at the position Pa again.

Further, the first sheet S is received by the compiling stack portion 35. The end of the first sheet S near the end guide 35*b* reaches the end guide 35*b*. Then the first tamper 38*a* is moved from the position Ta4 to the position Ta2. At this time, the second tamper 38*b* is still arranged at the position Tb3. Accordingly, the first tamper 38*a* pushes the first sheet S, and the first sheet S contacts the second tamper 38*b*. Then, the first tamper 38*a* is separated from the first sheet S and is arranged at the position Ta4 again.

When second and later sheets S with toner images formed by the image forming unit 5 next to the first sheet S are fed successively to the post-processing device 30, the paddle 37 and the tamper 38 align the ends of the sheets S in a manner similar to the above-described operation. The second sheet S is fed after the first sheet S is aligned, and the second sheet S is aligned with the first sheet S. The operation is similarly provided also when third and later sheets S are fed. Accordingly, sheets S are housed in the compiling stack portion 35 by a predetermined number, the ends of the sheets S are aligned, and a sheet bundle B is formed.

Next, the first staple-less binding mechanism 50*a* performs the binding processing on the sheet bundle B stacked on the compiling stack portion 35. Offset processing is performed on the sheet bundle B bound by the first staple-less binding mechanism 50*a* if necessary (described later).

Then, the first eject roller 39*a* moves downward form the position P1 (moves in the direction indicated by arrow Q1 in FIG. 2), and is arranged at the position P2. Then, when the first eject roller 39*a* rotates (arrow T1 in FIG. 2), the sheet bundle B moves upward along the bottom portion 35*a* of the compiling stack portion 35 (the third travel direction S3 in FIG. 2). The sheet bundle B output from the compiling stack portion 35 is stacked on the stack portion 70 through the opening 69.

Offset Operation

Figure 7A:
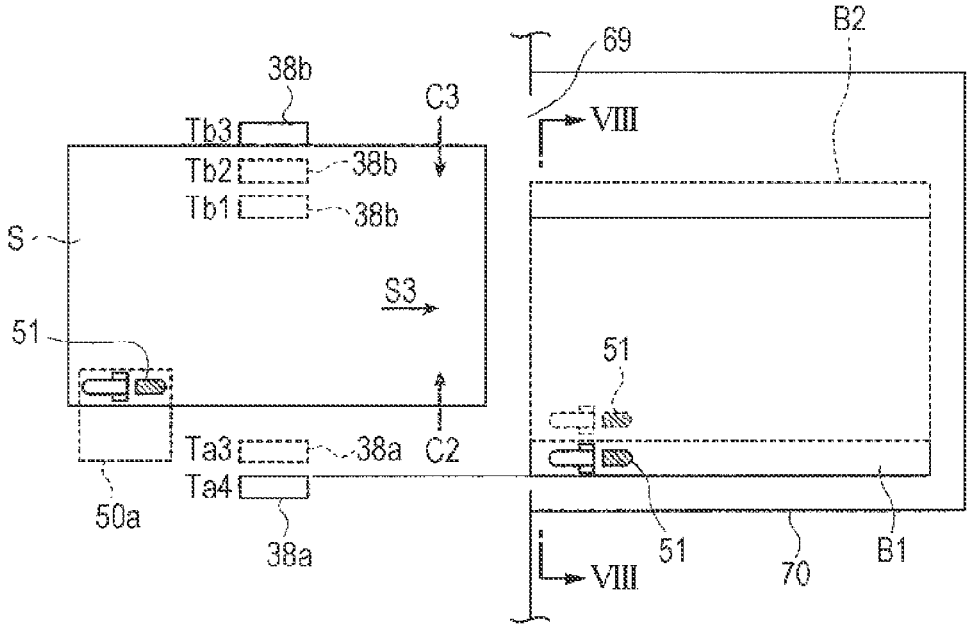
FIGS. 7A and 7B each are an explanatory view showing an operation of offsetting sheet bundles.
Figure 7B:
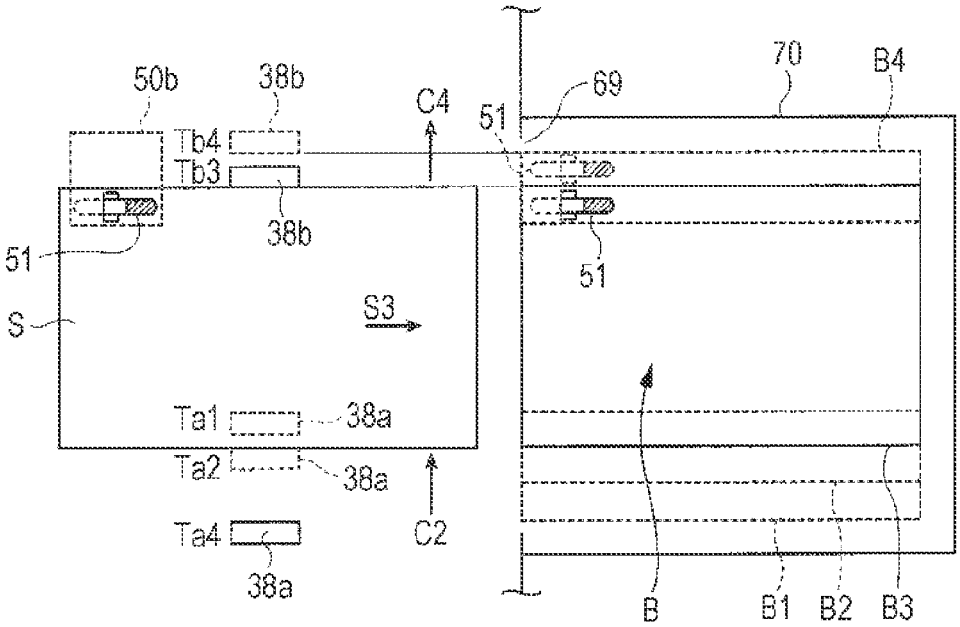

An operation of offsetting the sheet bundle B stacked on the stack portion 70 is described with reference to FIGS. 7A and 7B. FIGS. 7A and 7B each are an explanatory view showing an operation of offsetting the sheet bundle B. To be more specific, FIG. 7A is an explanatory view showing arrangement on the stack portion 70 of a sheet bundle B bound by the first staple-less binding mechanism 50*a*, and FIG. 7B is an explanatory view showing arrangement on the stack portion 70 of a sheet bundle B bound by the second staple-less binding mechanism 50*b*.

For an example of an operation for providing a stack example shown in FIG. 8H (described later), described here is arrangement of sheet bundles B at four positions on the stack portion 70.

Also, while a first sheet bundle B1 to a fourth sheet bundle B continuously successively fed to the stack portion 70 are described, if a fifth sheet bundle (not shown) and later sheet bundles B are fed, the following operation is repeated.

First, as described above, while the second tamper 38*b* is arranged at the position Tb3, the movement of the first tamper 38*a* from the position Ta4 to the position Ta2 is repeated every time when a sheet S is fed to the compiling stack portion 35. Hence, the ends of the sheets S are aligned and a sheet bundle B is formed. The binding processing is performed on the sheet bundle B, and then the offset processing is performed on the sheet bundle B.

The first staple-less binding mechanism 50*a* performs the binding processing on the first sheet bundle B1. When the first staple-less binding mechanism 50*a* performs the binding processing, the first tamper 38*a* is arranged at the position Ta4. Then, the offset processing is performed on the bound first sheet bundle B1. That is, the second tamper 38*b* moves from the position Tb3 to the Tb1 (arrow C3). Accordingly, the first sheet bundle B1 is pushed in a direction indicated by arrow C3, and contacts the first tamper 38*a* arranged at the position Ta4. Then, the first sheet bundle B1 contacting the first tamper 38*a* is output to the stack portion 70 by the eject roller 39.

The first staple-less binding mechanism 50*a* performs the binding processing on the second sheet bundle B2 which is formed next, and then the first tamper 38*a* moves from the position Ta4 to the position Ta3 (arrow C2). Then, the second tamper 38*b* moves from the position Tb3 to the Tb2 (arrow C3). Accordingly, the second sheet bundle B2 is pushed in a direction indicated by arrow C3, and contacts the first tamper 38*a* arranged at the position Ta3. The second sheet bundle B2 with the offset processing performed thereon is output to the stack portion 70 by the eject roller 39.

The second staple-less binding mechanism 50*b* performs the binding processing on the third sheet bundle B3 which is formed next, then the first tamper 38*a* moves from the position Ta4 to the position Ta2 (arrow C2), and the third sheet bundle B3 is output to the stack portion 70 by the eject roller 39.

The second staple-less binding mechanism 50*b* performs the binding processing on the fourth sheet bundle B4 which is formed next, and then the second tamper 38*b* moves from the position Tb3 to the position Tb4 (arrow C4). Then, the first tamper 38*a* moves from the position Ta4 to the position Ta1 (arrow C2), hence the offset processing is performed on the fourth sheet bundle B4, and the fourth sheet bundle B4 is output to the stack portion 70 by the eject roller 39.

First Stack Arrangement

The first sheet bundle B1 to the fourth sheet bundle B4 stacked on the stack portion 70 are described with reference to FIGS. 8A to 8I.

Figure 8A:
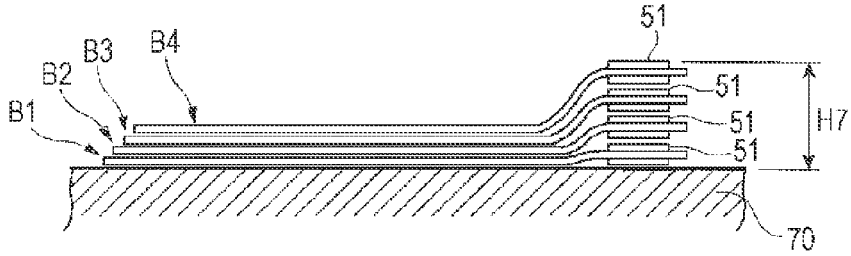
FIGS. 8A to 8I each are a cross-sectional view of sheet bundles stacked on a stack portion when taken along line VIII-VIII in FIG. 7A.
Figure 8B:
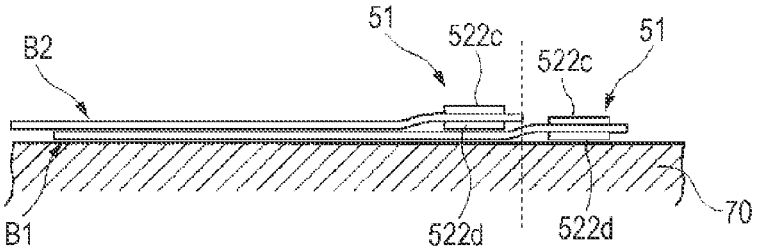
Figure 8C:
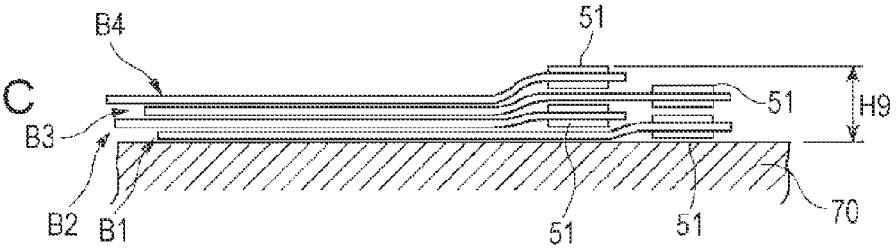
Figure 8D:
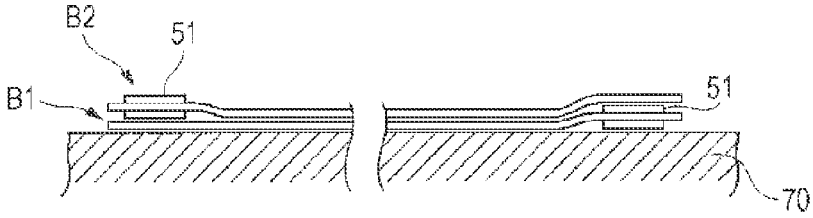
Figure 8E:
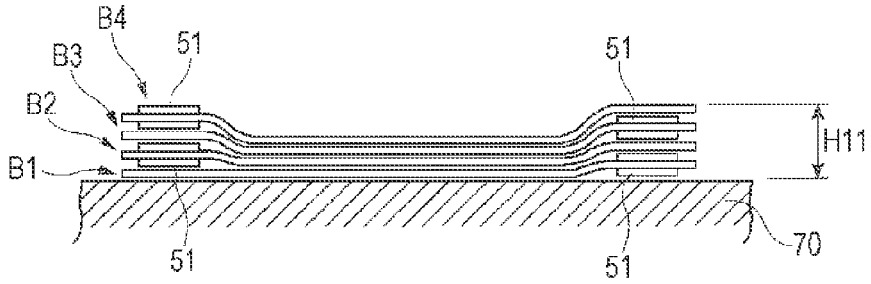
Figure 8F:
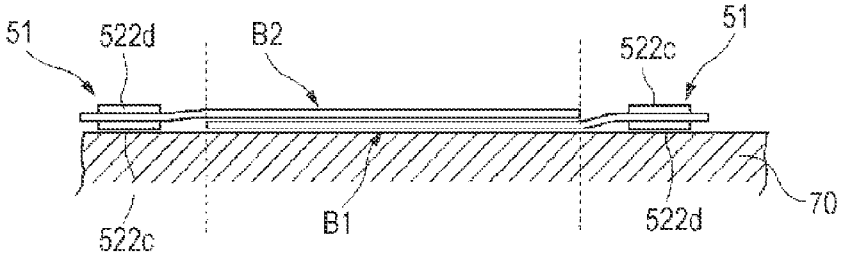
Figure 8G:
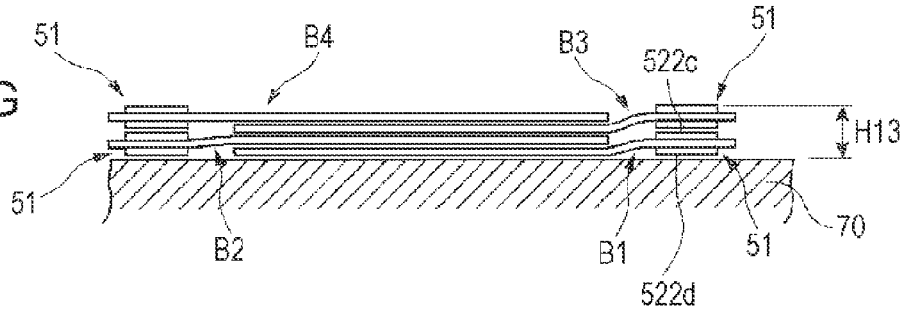
Figure 8H:
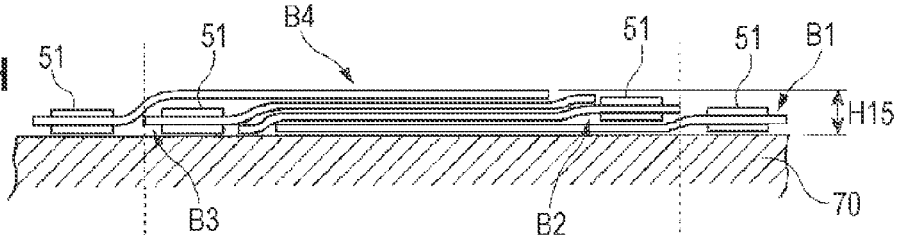
Figure 8I:
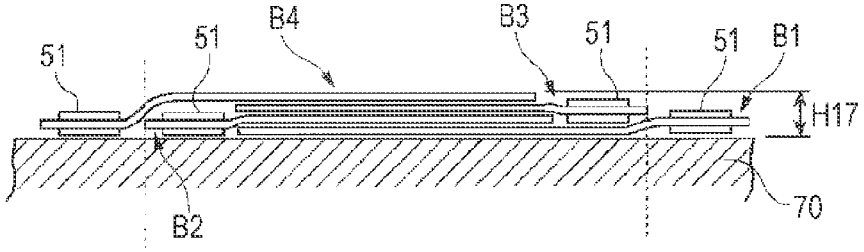

FIGS. 8A to 8I each are a cross-sectional view of the sheet bundles B stacked on the stack portion 70 when taken along line VIII-VIII in FIG. 7A. To be more specific, FIG. 8A illustrates the first sheet bundle B1 to the fourth sheet bundle B4 according to a comparative example, FIG. 8B illustrates a first bound-part arrangement form, FIG. 8C illustrates the first sheet bundle B1 to the fourth sheet bundle B4 stacked in the first bound-part arrangement form, FIG. 8D illustrates a second bound-part arrangement form, FIG. 8E illustrates the first sheet bundle B1 to the fourth sheet bundle B4 stacked in the second bound-part arrangement form, FIG. 8F illustrates a third bound-part arrangement form, FIG. 8G illustrates the first sheet bundle B1 to the fourth sheet bundle B4 stacked in the third bound-part arrangement form, FIG. 8H illustrates the first sheet bundle B1 to the fourth sheet bundle B4 stacked in the first and third bound-part arrangement forms, and FIG. 8I is a modification of FIG. 8H.

As shown in FIG. 8A which is a comparative example being different from the exemplary embodiment, if the first sheet bundle B1 to the fourth sheet bundle B4 are stacked such that the bound parts 51 of the sheet bundles are aligned with each other, a total height H7 of the stacked first sheet bundle B1 to fourth sheet bundle B4 is 12 times the height H1 of the sheet bundle B (see FIG. 6B). If the first sheet bundle B1 to the fourth sheet bundle B4 are stacked as shown in FIG. 8A, the accumulation of bulges of the bound parts 51 causes the entire first sheet bundle B1 to fourth sheet bundle B4 to become unstable. This bound-part arrangement form is not suitable for stacking a large number of sheet bundles.

Now, the first bound-part arrangement form shown in FIG. 8B is described. In the first bound-part arrangement form, the first sheet bundle B1 and the second sheet bundle B2 bound by the first staple-less binding mechanism 50*a* are arranged at positions so that the bound parts 51 do not contact each other. More specifically, the first part 522*c* of the bound part 51 of the first sheet bundle B1 is arranged (offset) at a position so as not to contact the second part 522*d* of the bound part 51 of the second sheet bundle B2. Further, in the illustrated example, the first part 522*c* of the bound part 51 of the first sheet bundle B1 is arranged at a position not to contact the second sheet bundle B2 such that the first part 522*c* of the bound part 51 of the first sheet bundle B1 is shifted to the outside of the end of the second sheet bundle B2 (the right side of a broken line in the drawing).

If the first bound-part arrangement form shown in FIG. 8B is applied to the comparative example shown in FIG. 8A, an arrangement form shown in FIG. 8C is provided. As shown in FIG. 8C, a total height H9 of the stacked first sheet bundle B1 to fourth sheet bundle B4 is 8 times the height H1 of the sheet bundle B (see FIG. 6B). Accordingly, the total height of the sheet bundles B is reduced as compared with the comparative example shown in FIG. 8A, and the stacked first sheet bundle B1 to fourth sheet bundle B4 become stable.

Next, the second bound-part arrangement form shown in FIG. 8D is described. In the second bound-part arrangement form, the bound part 51 of the first sheet bundle B1 bound by the first staple-less binding mechanism 50*a* is formed at the right end in the drawing of the sheet bundle B. In contrast, the bound part 51 of the second sheet bundle B2 bound by the second staple-less binding mechanism 50*b* is formed at the left end in the drawing of the sheet bundle B. As described above, the bound parts 51 respectively formed by the first staple-less binding mechanism 50*a* and the second staple-less binding mechanism 50*b* are sorted to the opposite ends of the sheet bundles B (the ends in the left-right direction of the sheet bundles B in the drawing). In other words, the bound parts 51 respectively formed by the first staple-less binding mechanism 50*a* and the second staple-less binding mechanism 50*b* are arranged at positions not to contact each other as illustrated.

If the second bound-part arrangement form shown in FIG. 8D is applied to the comparative example shown in FIG. 8A, an arrangement form shown in FIG. 8E is provided. As shown in FIG. 8E, a total height H11 of the stacked first sheet bundle B1 to fourth sheet bundle B4 is 8 times the height H1 of the sheet bundle B (see FIG. 6B). Accordingly, the total height of the sheet bundles B is reduced as compared with the comparative example in FIG. 8A. Also, since the bound parts 51 of the first sheet bundle B1 to fourth sheet bundle B4 are arranged at both ends in the left-right direction in the drawing, the arrangement becomes stable.

Next, the third bound-part arrangement form shown in FIG. 8F is described. In the third bound-part arrangement form, the bound part 51 of the first sheet bundle B1 bound by the first staple-less binding mechanism 50*a* is formed at the right end in the drawing of the sheet bundle B. In contrast, the bound part 51 of the second sheet bundle B2 bound by the second staple-less binding mechanism 50*b* is formed at the left end in the drawing of the sheet bundle B. Further, the first part 522*c* of the bound part 51 of the first sheet bundle B1 is arranged (offset) at a position not to contact the second sheet bundle B2 such that the first part 522*c* of the bound part 51 of the first sheet bundle B1 is shifted to the outside of an end opposite to an end with the bound part 51 of the second sheet bundle B2 (the right side of a broken line in the drawing). Similarly, the first part 522*c* of the bound part 51 of the second sheet bundle B2 is arranged outside an end opposite to an end with the bound part 51 of the first sheet bundle B1 (the left side of a broken line in the drawing).

If the third bound-part arrangement form shown in FIG. 8F is applied to the comparative example shown in FIG. 8A, an arrangement form shown in FIG. 8G is provided. As shown in FIG. 8G, a total height H13 of the stacked first sheet bundle B1 to fourth sheet bundle B4 is 6 times the height H1 of the sheet bundle B (see FIG. 6B). Accordingly, the total height of the sheet bundles B is reduced as compared with the comparative example in FIG. 8A. Also, since the bound parts 51 of the first sheet bundle B1 to fourth sheet bundle B4 are arranged at both ends in the left-right direction in the drawing, the arrangement becomes more stable. Further, for example, if the left end in the drawing of the second sheet bundle B2 shown in FIG. 8G receives a force to the right side, movement in that direction of the left end of the second sheet bundle B2 is interrupted by the first part 522*c* of the first sheet bundle B1. Accordingly, the stacked first sheet bundle B1 to fourth sheet bundle B4 become further stable, and are prevented from being collapsed from the stacked state.

If the first bound-part arrangement form shown in FIG. 8B and the third bound-part arrangement form shown in FIG. 8F are applied to the comparative example shown in FIG. 8A, an arrangement shown in FIG. 8H is provided. As shown in FIG. 8H, a total height H15 of the stacked first sheet bundle B1 to fourth sheet bundle B4 is 4 times the height H1 of the sheet bundle B (see FIG. 6B). Accordingly, the total height of the sheet bundles B is reduced as compared with the comparative example in FIG. 8A.

As shown in FIG. 8H, the total height H15 of the stacked first sheet bundle B1 to fourth sheet bundle B4 is equivalent to a height when the first sheet bundle B1 to the fourth sheet bundle B4 without the bound parts 51 are stacked. Also, the stacked first sheet bundle B1 to fourth sheet bundle B4 are arranged in a flat manner.

The form in which the first bound-part arrangement form shown in FIG. 8B and the third bound-part arrangement form shown in FIG. 8F are applied to the comparative example shown in FIG. 8A is not limited to the form shown in FIG. 8H in which the binding is switched between the binding by the first staple-less binding mechanism 50*a* and the binding by the second staple-less binding mechanism 50*b*. For example, a configuration may be provided in which the binding processing for a sheet bundle B is alternately provided by the first staple-less binding mechanism 50*a* and the second staple-less binding mechanism 50*b*, for example, as shown in FIG. 8I, as long as the binding processing is performed by the first staple-less binding mechanism 50*a* and the second staple-less binding mechanism 50*b*, and the sheet bundles B are offset at opposite ends, so that the bound parts 51 are stacked in a shifted manner.

The stack form of the sheet bundles B is described such that both ends of the first sheet bundle B1 to fourth sheet bundle B4 are stacked in the same form. However, the stack arrangement is not limited thereto, and as long as the bound parts 51 are shifted and stacked, both ends of the first sheet bundle B1 to fourth sheet bundle B4 may be stacked in different forms. For example, the first bound-part arrangement form shown in FIG. 8B and the third bound-part arrangement form shown in FIG. 8F may be applied to first ends of the first sheet bundle B1 to fourth sheet bundle B4, and only the third bound-part arrangement form shown in FIG. 8F may be applied to second ends.

As described above, the longitudinal direction of the tongue 522 of the bound part 51 is arranged along the third travel direction S3 (see FIG. 6D). Owing to this, as compared with a case in which the longitudinal direction of the tongue 522 of the bound part 51 is arranged in a direction intersecting with the third travel direction S3, the length of the bound part 51 in the direction intersecting with the third travel direction S3 (the length in the left-right direction in FIGS. 8A to 8I) is smaller.

Accordingly, the moving amounts and moving times of the first tamper 38*a* and the second tamper 38*b* while the first sheet bundle B1 to the fourth sheet bundle B4 are offset are reduced. Further, the area of the stack portion 70 required for stacking the first sheet bundle B1 to the fourth sheet bundle B4 is reduced.

Second Stack Arrangement

Next, a second stack arrangement of sheet bundles B on the stack portion 70 is described with reference to FIGS. 9, and 10A to 10C.

Figure 9:
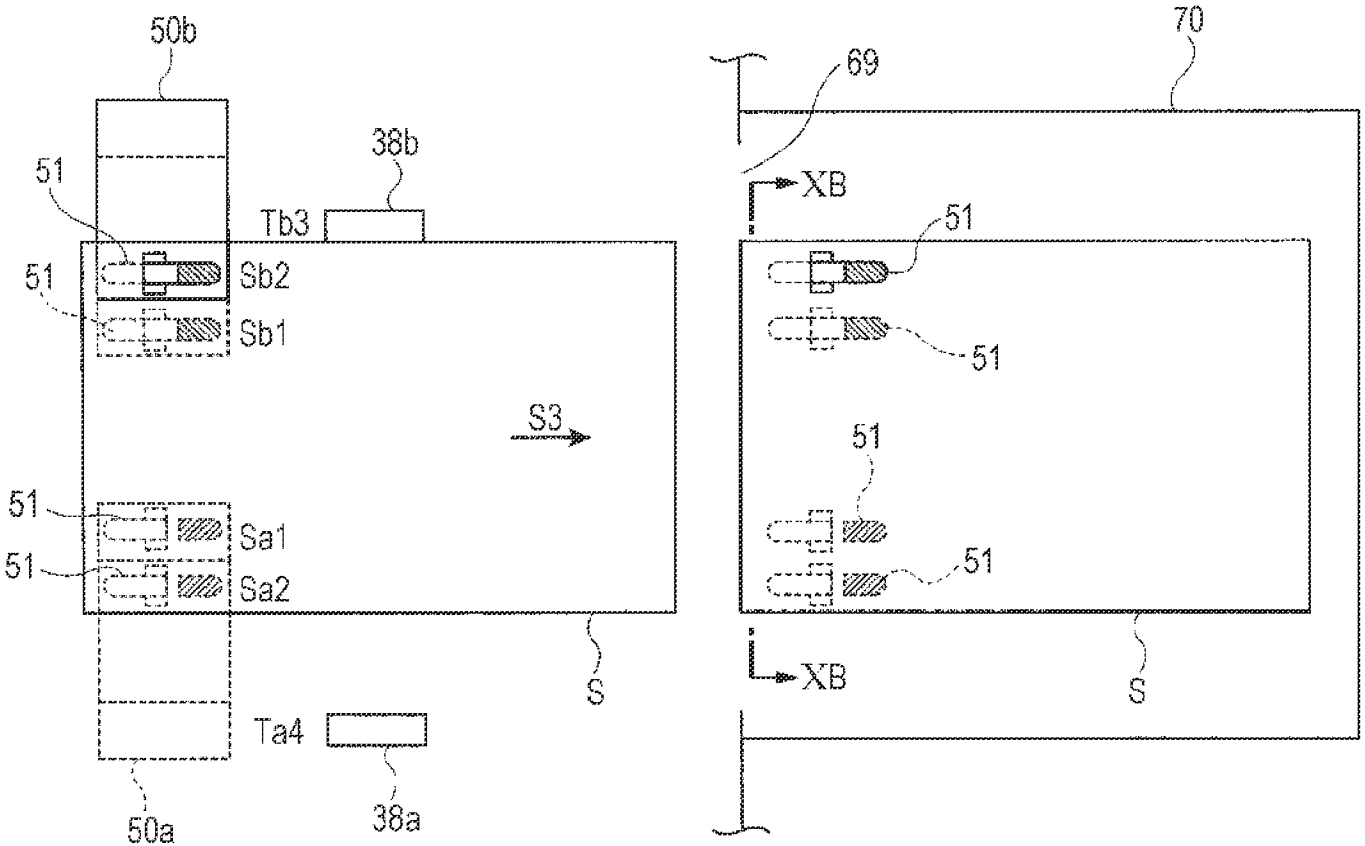
FIG. 9 is an explanatory view showing arrangement on the stack portion of sheet bundles bound by the staple-less binding mechanism.
Figure 10A:
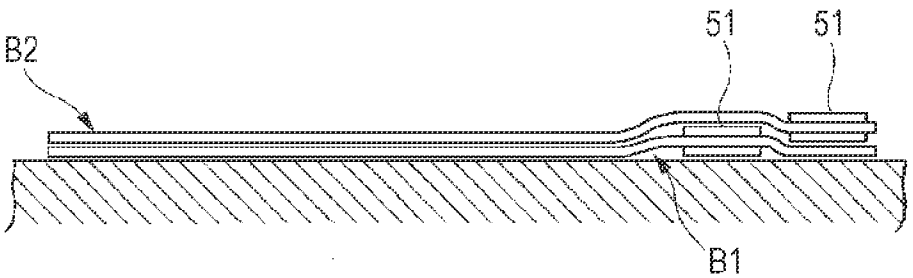
FIGS. 10A to 10C are each an explanatory view showing arrangement of sheet bundles according to a second stack arrangement.
Figure 10B:
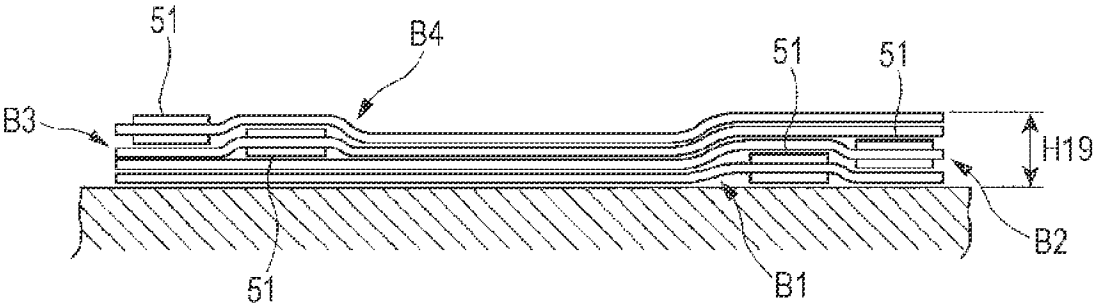
Figure 10C:
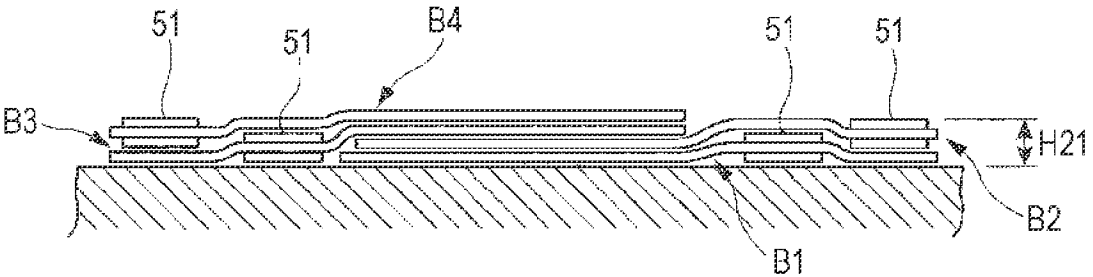

FIG. 9 is an explanatory view showing arrangement on the stack portion 70 of sheet bundles B bound by the staple-less binding mechanism 50. FIGS. 10A to 10C are each an explanatory view showing arrangement of sheet bundles B according to the second stack arrangement. To be more specific, FIG. 10A illustrates a fourth bound-part arrangement form, FIG. 10B is a cross-sectional view taken along line XB-XB in FIG. 9 of the first sheet bundle B1 to the fourth sheet bundle B4 stacked on the stack portion 70, and FIG. 10C is an explanatory view showing arrangement on the stack portion 70 of the first sheet bundle B1 to the fourth sheet bundle B4 according to a modification.

The first sheet bundle B1 to the fourth sheet bundle B4, which are continuously successively fed to the stack portion 70, are described. Also, described below is a form in which the first staple-less binding mechanism 50*a* performs the binding processing on the first sheet bundle B1 and the second sheet bundle B2, and the second staple-less binding mechanism 50*b* performs the binding processing on the third sheet bundle B3 and the fourth sheet bundle B4. If sheet bundles of a fifth sheet bundle (not shown) and later sheet bundles are fed, the operation when the first sheet bundle B1 to the fourth sheet bundle B4 are fed is repeated.

In the above-described first stack arrangement, the first staple-less binding mechanism 50*a* and the second staple-less binding mechanism 50*b* perform the binding processing while the sheet bundles B are moved but the first staple-less binding mechanism 50*a* or the second staple-less binding mechanism 50*b* is not moved in the direction intersecting with (orthogonal to) the third travel direction S3. In contrast, as shown in FIG. 10A, a form is applied to this stack arrangement, in which the bound parts 51 are formed at different positions in the sheet bundles B while the sheet bundles B are not moved, so that the bound parts 51 are arranged at positions not to contact each other.

More specifically, the first sheet bundle B1 to the fourth sheet bundle B4 are stacked on the stack portion 70 while the binding processing is performed on the first sheet bundle B1 to the fourth sheet bundle B4 as follows.

First, sheets S are successively fed to the compiling stack portion 35, the ends of the sheets S are aligned by the first tamper 38*a* and the second tamper 38*b*, and hence the first sheet bundle B1 is formed. Then, in response to a signal from the controller 80, the first staple-less binding mechanism 50*a* moves from the position Sa2 to the position Sa1 by driving of a motor or the like (not shown). The first staple-less binding mechanism 50*a* at the position Sa1 performs the binding processing on the first sheet bundle B1, and then the first sheet bundle B1 is output to the stack portion 70 by the eject roller 39.

Next, when the second sheet bundle B2 is formed, the first staple-less binding mechanism 50*a* moves from the position Sa1 to the position Sa2 by a motor or the like (not shown). Then, the first staple-less binding mechanism 50*a* at the position Sa2 performs the binding processing on the second sheet bundle B2, and then the second sheet bundle B2 is output to the stack portion 70 by the eject roller 39.

Next, when the third sheet bundle B3 is formed, the second staple-less binding mechanism 50*b* moves from the position Sb2 to the position Sb1 and then performs the binding processing. The third sheet bundle B3 with the binding processing performed thereon is output to the stack portion 70 by the eject roller 39.

Next, when the fourth sheet bundle B4 is formed, the second staple-less binding mechanism 50*b* moves from the position Sb1 to the position Sb2 and then performs the binding processing. The fourth sheet bundle B4 with the binding processing performed thereon is output to the stack portion 70 by the eject roller 39.

As described above, in the second stack arrangement, the positions at which the first staple-less binding mechanism 50*a* and the second staple-less binding mechanism 50*b* perform the binding processing are moved in the direction intersecting with the third travel direction S3 while the sheet bundles B are not moved (offset) in the direction intersecting with the third travel direction S3.

Accordingly, as shown in FIG. 10B, the first sheet bundle B1 to the fourth sheet bundle B4 stacked on the stack portion 70 are arranged so that the respectively formed bound parts 51 are arranged at different positions. Hence, the bound parts 51 are prevented from contacting each other.

As shown in FIG. 10B, a total height H19 of the stacked first sheet bundle B1 to fourth sheet bundle B4 is 6 times the height H1 of the sheet bundle B (see FIG. 6B). Accordingly, the total height H19 of the stacked first sheet bundle B1 to fourth sheet bundle B4 is reduced as compared with the comparative example shown in FIG. 8A.

In the second stack arrangement, for example, the bound part 51 formed at the sheet bundle B is prevented from being damaged because the sheet bundle B is moved in the direction intersecting with the third travel direction S3. Also, in the second stack arrangement, the area required for stacking the first sheet bundle B1 to the fourth sheet bundle B4 on the stack portion 70 is reduced.

In this case, the first staple-less binding mechanism 50*a* and the second staple-less binding mechanism 50*b* each perform the binding processing at the two positions in the direction intersecting with the third travel direction S3. However, as long as the bound parts 51 formed at the sheet bundles B do not contact each other, for example, the first staple-less binding mechanism 50*a* (or the second staple-less binding mechanism 50*b*) may perform the binding processing at three or more positions in the direction intersecting with the third travel direction S3.

Also, as long as the first staple-less binding mechanism 50*a* and the second staple-less binding mechanism 50*b* change the binding positions respectively for the sheet bundles B in the direction intersecting with the third travel direction S3, the sheet bundle B may be moved in addition to that the position of the binding processing is moved.

For example, as shown in FIG. 10C, the first sheet bundle B1 and the second sheet bundle B2 bound by the first staple-less binding mechanism 50*a* may be offset from the third sheet bundle B3 and the fourth sheet bundle B4 bound by the second staple-less binding mechanism 50*b*. The form shown in FIG. 10C may be recognized as a form in which the third bound-part arrangement form shown in FIG. 8F and the fourth bound-part arrangement form shown in FIG. 10A are applied to the comparative example shown in FIG. 8A.

As shown in FIG. 10C, a total height H21 of the stacked first sheet bundle B1 to fourth sheet bundle B4 is 4 times the height H1 of the sheet bundle B (see FIG. 6B). Accordingly, by stacking the first sheet bundle B1 to the fourth sheet bundle B4 as shown in FIG. 10C, the total height H21 of the stacked first sheet bundle B1 to fourth sheet bundle B4 is reduced as compared with the comparative example shown in FIG. 8A.

The stack form of the sheet bundles B is not limited to that both ends of the first sheet bundle B1 to fourth sheet bundle B4 are stacked in the same form. As long as the bound parts 51 are shifted and stacked, the first sheet bundle B1 to fourth sheet bundle B4 may be stacked so that both ends are arranged in different forms.

Orientation of Image

Referring to FIGS. 1, 3, 4A and 4B, and 11A to 11C, the relationship between a bound part 51 formed at a sheet bundle B and an image formed on a sheet S forming the sheet bundle B is described.

Figure 11A:
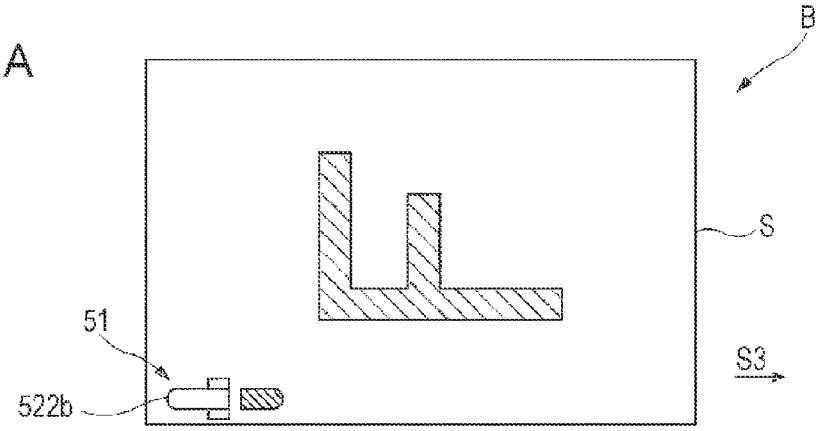
FIGS. 11A to 11C are each an explanatory view showing the relationship between a bound part of a sheet and an image formed on the sheet.
Figure 11B:
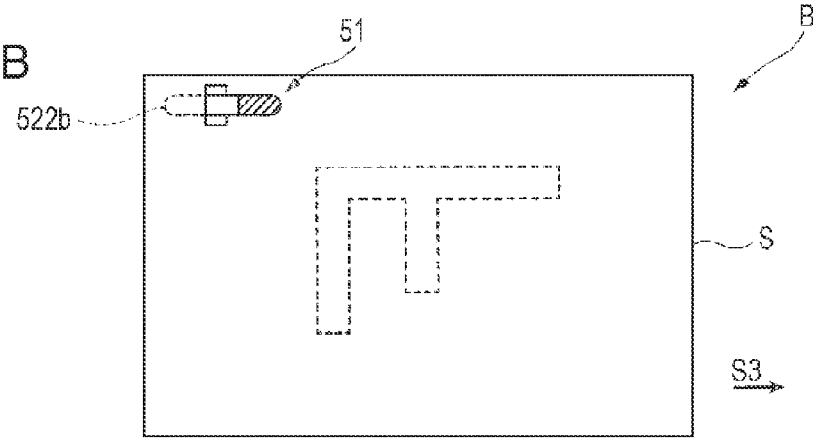
Figure 11C:
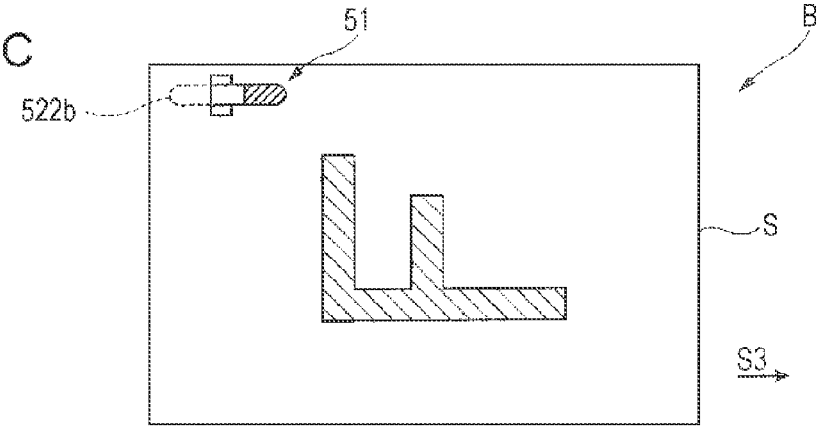

FIGS. 11A to 11C are each an explanatory view showing the relationship between a bound part 51 and an image formed on a sheet S, and each illustrate a view when the sheet bundle B output to the stack portion 70 is viewed from the upper surface. To be more specific, FIG. 11A is an explanatory view showing a sheet bundle B bound by the first staple-less binding mechanism 50*a*, and FIG. 11B is an explanatory view showing a sheet bundle B bound by the second staple-less binding mechanism 50*b*. Also, FIG. 11C is an explanatory view showing another example of a sheet bundle B bound by the second staple-less binding mechanism 50*b*.

As described above, the first staple-less binding mechanism 50*a* and the second staple-less binding mechanism 50*b* respectively bind opposite ends of sheet bundles B (see FIG. 3). As shown in FIGS. 11A and 11C, for example, when an image is formed on the upper surface of a sheet bundle B output to the stack portion 70, if the first staple-less binding mechanism 50*a* and the second staple-less binding mechanism 50*b* perform the binding processing on successively output sheet bundles B, positions at which bound parts 51 are formed at the sheet bundles B are different. In the illustrated example, the bound part 51 is formed at a lower left corner in the drawing of the sheet S shown in FIG. 11A, and the bound part 51 is formed at an upper left corner of the sheet S shown in FIG. 11C.

In this exemplary embodiment, the positions and orientations (front and back) of the bound parts 51 at the sheet bundles B are aligned between the sheet bundle B with the bound part 51 formed by the first staple-less binding mechanism 50*a*, and the sheet bundle B with the bound part 51 formed by the second staple-less binding mechanism 50*b*.

More specifically, the respective devices are operated as follows.

First, an image is formed on a sheet S by the image forming unit 5 of the image forming apparatus 2 under control by the controller 80. At this time, the image is formed on the sheet S by the image forming unit 5, in a first direction. Also, images are respectively formed on plural sheets S (from 1 to N) which form a sheet bundle B in order from N to 1. The sheets S with the images formed by the image forming unit 5 in that order are transported to the compiling stack portion 35 while the sheets S are not reversed by the sheet reverse device 7. The plural sheets S are stacked on the compiling stack portion 35 and a sheet bundle B is formed. Then, the binding processing is performed by the first staple-less binding mechanism 50*a*. As shown in FIG. 11A, the image is formed on the upper surface of the sheet bundle B output to the stack portion 70, and the sheets are stacked in order from 1 to N from the upper surface to the lower surface while being stacked on the stack portion 70.

In contrast, when the sheet bundle B is formed in a form shown in FIG. 11B, the respective devices are operated as follows. First, an image is formed on a sheet S by the image forming unit 5 of the image forming apparatus 2 under control by the controller 80. At this time, the image is formed on the sheet S by the image forming unit 5 in a second direction which is rotated from the first direction by 180 degrees. Also, plural sheets S (from 1 to N) which form a sheet bundle B are formed in order from 1 to N. Further, the sheets S with the images formed in that order by the image forming unit 5 are reversed by the sheet reverse device 7. When each sheet S is reversed, the back surface and the front surface of the sheet S is reversed, and the leading end and the rear end of the sheet S in the transport direction of the sheet S is reversed. After the plural sheets S are stacked on the compiling stack portion 35 and a sheet bundle B is formed, the binding processing is performed by the second staple-less binding mechanism 50*b*. As shown in FIG. 11B, the image is formed on the lower surface of the sheet bundle B output to the stack portion 70, and the sheets S are stacked in order from N to 1 from the upper surface to the lower surface while being stacked on the stack portion 70.

As described above, the formation order of images by the image forming unit 5 for the sheet bundle B bound by the first staple-less binding mechanism 50*a* is reverse of that for the sheet bundle B bound by the second staple-less binding mechanism 50*b* through the control by the controller 80. Also, the orientation of images to be formed is reversed. Then, the sheet reverse device 7 switches between the reversal and non-reversal of sheets. Accordingly, the positions and orientations (front and back) of the bound parts 51 are aligned in the sheet bundles B in which the sheets S with images formed are grouped.

As shown in FIGS. 4A and 4B, the first staple-less binding mechanism 50*a* and the second staple-less binding mechanism 50*b* are arranged in a vertically reversed manner. Hence, the front and back orientations of the bound parts 51 in the sheet bundles B may be aligned by switching the control by the controller 80 for the image forming unit 5 and the sheet reverse device 7 without necessity of that, for example, the second staple-less binding mechanism 50*b* is vertically reversed. The illustrated exemplary embodiment provides a form in which the second end 522*b*, which is the distal end of the tongue 522, is arranged at the surface of the sheet bundle B with the image formed.

As shown in FIGS. 11A and 11B, the positions and orientations (front and back) of the bound parts 51 of the sheet bundles B do not have to be aligned, and for example, a sheet bundle B may be formed as shown in FIG. 11C, as long as the first staple-less binding mechanism 50*a* and the second staple-less binding mechanism 50*b* respectively bound the opposite ends of the sheet bundles B as described above. Alternatively, the orientation of images formed by the image forming unit 5 on the sheet bundle B bound by the first staple-less binding mechanism 50*a* may be only rotated by 180 degrees with respect to the orientation of images on the sheet bundle B bound by the second staple-less binding mechanism 50*b*. Still alternatively, the formation order of images on the sheets S by the image forming unit 5 and the reversal and non-reversal of sheets by the sheet reverse device 7 may be switched.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming mechanism that respectively forms a plurality of images on a plurality of sheets;

a sheet-bundle forming unit that stacks the plurality of sheets with the images formed by the image forming mechanism, and forms a sheet bundle;

a binding unit that forms a cut in the sheet bundle formed by the sheet-bundle forming unit, forms a tongue in the sheet bundle by cutting part of the sheet bundle into a predetermined shape so that a first end remains uncut and continues to the sheet bundle, and binds the sheet bundle by folding the tongue and inserting a second end of the tongue into the cut, wherein the binding unit includes a first binding mechanism that binds a first sheet bundle at a first side in a direction intersecting with a transport direction of the sheet bundle, and a second binding mechanism that binds a second sheet bundle at a second side in the direction intersecting with the transport direction of the sheet bundle;

a transport unit that transports the sheet bundle bound by the binding unit;

a stack unit that stacks the sheet bundle transported by the transport unit at a position that is the same as a position of other sheet bundles transported by the transport unit;

a position change unit that changes a position of binding processing performed on the sheet bundle by the binding unit so that the tongue formed in the sheet bundle stacked on the stack unit does not contact another tongue formed in another sheet bundle stacked on the stack unit;

a rotation unit that rotates an orientation of the images formed on the sheets by the image forming mechanism, in accordance with whether the first binding mechanism performs the binding processing or the second binding mechanism performs the binding processing; and a switch unit that switches a formation order of the images on the sheets forming the sheet bundle by the image forming mechanism, in accordance with whether the first binding mechanism performs the binding processing or the second binding mechanism performs the binding processing.

* * * * *